US008241561B2

(12) United States Patent
Gejima et al.

(10) Patent No.: US 8,241,561 B2
(45) Date of Patent: Aug. 14, 2012

(54) STRESS-BUFFERING MATERIAL

(75) Inventors: Fumihiko Gejima, Yokohama (JP); Hiroki Sakamoto, Yokohama (JP); Mamoru Sayashi, Kitami (JP)

(73) Assignees: Nissan Motor Co., Ltd., Yokohama-shi (JP); National University Corporation Kitami Institute of Technology, Kitami-shi (JP)

( * ) Notice: Subject to any disclaimer, the term of this patent is extended or adjusted under 35 U.S.C. 154(b) by 64 days.

(21) Appl. No.: 12/676,271

(22) Filed: Mar. 3, 2010

(65) Prior Publication Data

US 2010/0172792 A1 Jul. 8, 2010

(30) Foreign Application Priority Data

Sep. 14, 2007 (JP) ..... 2007-240079
May 12, 2008 (JP) ..... 2008-124704

(51) Int. Cl.
*C22C 21/00* (2006.01)

(52) U.S. Cl. ..... 420/528; 148/437

(58) Field of Classification Search ..... 420/528; 148/437

See application file for complete search history.

(56) References Cited

U.S. PATENT DOCUMENTS

| | | | | |
|---|---|---|---|---|
| 2,087,269 | A * | 7/1937 | Stroup | 420/528 |
| 4,126,448 | A | 11/1978 | Moore et al. | |
| 4,381,954 | A | 5/1983 | Piatti et al. | |

FOREIGN PATENT DOCUMENTS

| | | | |
|---|---|---|---|
| JP | 2848 | | 7/1930 |
| JP | 18529 | | 12/1941 |
| JP | 33-9657 | | 11/1958 |
| JP | 33-9658 | | 11/1958 |
| JP | 48-11218 | | 2/1973 |
| JP | 51-40313 | A | 4/1976 |
| JP | 59-38295 | | 9/1984 |
| JP | 59-190336 | A | 10/1984 |
| JP | 59-208770 | A | 11/1984 |
| JP | 06-145865 | A | 5/1994 |
| JP | 11-61307 | A | 3/1999 |
| JP | 11-80871 | A | 3/1999 |
| JP | 11-246926 | A | 9/1999 |
| JP | 11-246927 | A | 9/1999 |
| JP | 11-302765 | A | 11/1999 |
| JP | 2005-272945 | A | 10/2005 |

OTHER PUBLICATIONS

"Aluminum and Aluminum Alloys", ASM International, 1993, p. 41, 545, 639.*

"Effect of Superplasticity of Aluminium-Calcium-Zinc Alloy on Contents of Calcium and Zinc", *Light Alloy Fablication Technology*, vol. 1, (1988), pp. 39-41.

(Continued)

*Primary Examiner* — Roy King
*Assistant Examiner* — Janelle Morillo
(74) *Attorney, Agent, or Firm* — Foley & Lardner LLP

(57) ABSTRACT

Inventors of the present invention have found that, by manufacturing a stress-buffering material with a Ca-containing aluminum alloy including 0.1 to 12 at % of Ca, the stress-buffering material at low cost, capable of expanding its use in various fields, and having low Young's modulus that is beyond a conventional level, can be obtain.

4 Claims, 3 Drawing Sheets

OTHER PUBLICATIONS

Jorge A. del Valle et al., "Symbiosis between grain boundary sliding and slip creep to obtain high-strain-rate superplasticity in aluminum alloys", *Journal of the European Ceramic Society*, vol. 27, No. 11, (2007), pp. 3385-3390.

M.T. Pérez-Prado et al., "Microtexture Evolution during Annealing and Superplastic Deformation of AL-5 Pct Ca-5 Pct Zn", *Metallurgical and Materials Transactions*, vol. 29A, No. 2, (1998), pp. 485-492.

Ewald Veleckis et al., "Application of the Hydrogen Titration Method to a Thermodynamic Investigation of Solid Al—Ca Alloys", *Journal of the Less-Common Metals*, vol. 80, No. 2, (1981), pp. 241-255.

E. Amsterdam et al., "Failure mechanisms of closed-cell aluminum foam under monotonic and cyclic loading", *Acta Materialia*, vol. 54, No. 17, (2006), pp. 4465-4472.

* cited by examiner

STRESS-BUFFERING MATERIAL

TECHNICAL FIELD

The present invention relates to a stress-buffering material composed of an aluminum alloy capable of lowering stress effectively.

BACKGROUND ART

A metal material in which Young's modulus is lowered can obtain large elastic deformation with respect to load stress. Due to its flexible property, it is used for various purposes. For instance, when a metal material in which Young's modulus is lowered is used as a spring material, it is possible to downsize a spring since a winding number of the spring can be decreased. In addition, a metal material in which Young's modulus is lowered can improve usability when applying to glasses due to its flexible property. Moreover, a metal material in which Young's modulus is lowered can improve a flying distance when applying to golf clubs. Furthermore, such a metal material can be appropriately used for products such as robots and auxiliary materials for artificial bones.

For instance, metals such as iron and steel are used for hands and fingers of robots. However, when a robot is holding an object with its stainless-steel hand, there is a problem with the hand that tends to break the object since it is difficult to control a power to hold. Therefore, it is required that hands and fingers of robots are manufactured by use of materials capable of lowering stress effectively with low Young's modulus (stress-buffering materials). Also, when a metal with low Young's modulus can also lower a coefficient of linear expansion simultaneously, and, for instance, when the metal is used as components such as wiring members of a semiconductor module and various metal seals, the metal can be used as a stress-buffering material effectively absorbing thermal strain (thermal stress) caused by a difference of the coefficient of linear expansion from chips.

As described above, such a metal with low Young's modulus can be used for various purposes as a stress-buffering material. As a metal material with low Young's modulus, a titanium alloy and Ni—Ti shape memory alloy can be included, for instance. These are the metals based on titanium, and thus expensive. In addition, although Mg is a pure metal in which static Young's modulus is as low as 40 s GPa, a usage was limited due to low intensity, heat resistance, corrosion resistance, durability, and the like depending on purposes. Thus, it is required that a low elastic alloy based on aluminum that is relatively low-cost among metals is improved so as to be a material possible to be used as a stress-buffering material. As a low elastic material based on aluminum, an amorphous carbon fiber-reinforced aluminum composite material having a low elastic modulus is disclosed in Patent Citation 1, for instance.

However, the invention described in the above-mentioned Patent Citation 1 was unfavorable for mass production because of high production costs due to a composite material. Moreover, the invention described in Patent Citation 1 could not be used as a stress-buffering material for components of a semiconductor module (e.g. wiring members) and various metal seals, and the like.

The present invention has been made focusing on the above-mentioned problems. An object of the present invention is to provide a stress-buffering material composed of an aluminum alloy that is low-cost, can further expand its use in various fields, and has low Young's modulus in excess of a conventional level.

Patent Citation 1: Japanese Patent Unexamined Publication No. 2005-272945

DISCLOSURE OF INVENTION

As a result of repeated assiduous studies by the inventors to solve the above-mentioned problems, an inventive stress-buffering material composed of an aluminum alloy capable of achieving the above-mentioned object has been found, thereby accomplishing the present invention. In other words, the stress-buffering material according to the present invention is characterized by being composed of a Ca-containing aluminum alloy including 0.1 to 12 at % of Ca.

BEST MODE FOR CARRYING OUT THE INVENTION

Figure 1:
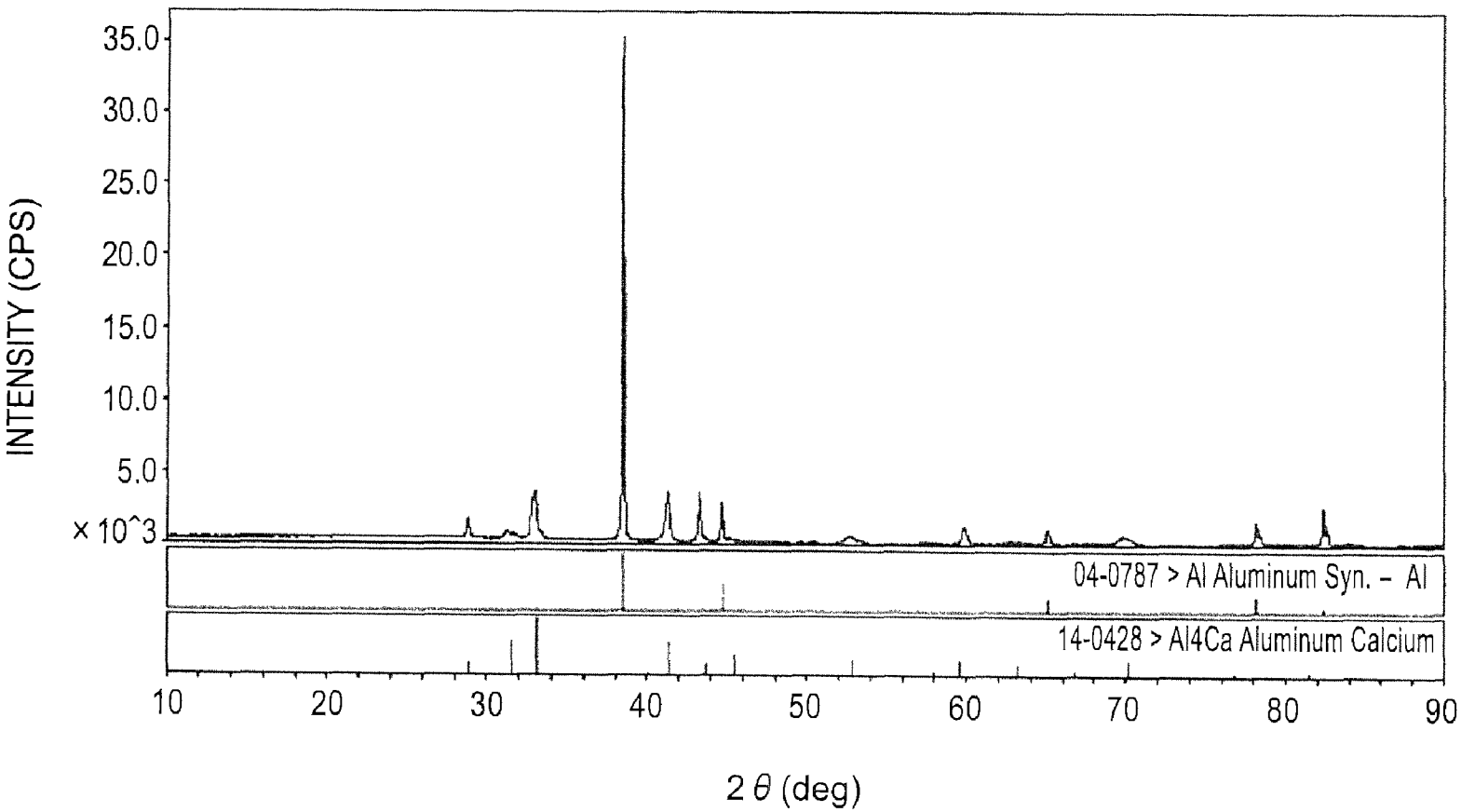
FIG. 1 is a view showing an X-ray diffraction pattern of a Ca-containing aluminum alloy of Example 3.

A stress-buffering material according to the present invention is characterized by being composed of a Ca-containing aluminum alloy including 0.1 to 12 at % of Ca. As a result of repeated assiduous studies by the inventors to solve the above-mentioned problems, an inventive technical information as described below has been found, thereby developing the stress-buffering material composed of the Ca-containing aluminum alloy that lowers Young's modulus and also lowers stress effectively.

More specifically, the aluminum alloy including 0.05 to 12 at % of Ca results in a two-phase structure of Al and $Al_4Ca$ at 616° C. or less. With regard to the alloy according to the present invention, a reason why Young's modulus is lowered is not apparent. However, it is assumed that an $Al_4Ca$ phase lowers Young's modulus. In addition, it has been found that Young's modulus is lowered with respect to pure Al by setting the Ca content between 0.1 at % to 12 at % and making the alloy composed of a two-phase structure. Note that, static Young's modulus of pure Al is approximately 70 GPa, while static Young's modulus obtained by the alloy according to the present invention is 60 GPa or less, preferably 50 GPa or less. The minimum of static Young's modulus is 30 s GPa, and therefore, the alloy can lower static Young's modulus by approximately half. Similarly, dynamic Young's modulus is 55 GPa or less, preferably 50 GPa or less, more preferably 45 GPa or less. The minimum of dynamic Young's modulus is 30 s GPa, and therefore, the alloy can lower dynamic Young's modulus by approximately half.

In addition, as a result of repeated assiduous studies with regard to properties other than Young's modulus, it has been found that a coefficient of linear expansion results in being smaller compared with pure Al. Moreover, it has been found that, even though thermal conductivity is smaller than pure Al, sufficiently high thermal conductivity of approximately 100 W/m·k can be achieved. Thus, the alloy can be appropriately applied to the stress-buffering material such as a wiring member, a heat sink, a semiconductor module and various metal seals.

Furthermore, by performing a structure control in order to meet conditions (1) to (4) described below, it has been found that Young's modulus, intensity, ductility, and other properties are balanced at a level capable of applying to various purposes appropriately.

(1) Being constructed of at least Al and a second phase composed of $Al_4$ in which a volume fraction of the second phase is within the range of 20 to 70%.

(2) Being constructed of at least Al and a second phase composed of $Al_4Ca$, in which the above second phase is uniformly dispersed in an Al matrix.

(3) Being constructed of at least Al and a second phase composed of $Al_4Ca$, in which an average size of the second phase is within the range of 0.01 to 20 μm.

(4) Having an X-ray diffraction peak of Al and $Al_4Ca$ by an X-ray diffraction method to meet the following formula (I). In the formula (I), $I_{Al}$ (111) represents (111) surface reflection intensity of Al, and $I_{Al4Ca}$ (112) represents (112) surface reflection intensity of $Al_4Ca$.

[Math 1]

$$2.5 \leqq I_{Al}(111)/I_{Al4Ca}(112) \leqq 100 \quad (1)$$

As described above, structure conditions and phase stability of the second phase in the Al—Ca alloy were specifically examined, thereby developing the stress-buffering material composed of an aluminum alloy with low Young's modulus. Namely, the stress-buffering material according to the present invention is characterized by being composed of the Ca-containing aluminum alloy including 0.1 to 12 at % of Ca. Note that, the stress-buffering material according to the present invention includes various configurations. Specifically, without limiting materials (such as ingot, slab, billet, sintered body, rolled product, forged product, wire rod, plate material and rod material), aluminum alloy members (such as interim product, end product and a part of those) obtained by processing such materials are also included. In addition, "being constructed of at least Al and a second phase composed of $Al_4Ca$" means that the alloy structure includes at least a first phase composed of Al and a second phase composed of $Al_4Ca$, and may further include the other phase (a third phase or more) other than the Al phase and the $Al_4Ca$ phase. That is, the alloy structure may have a two-phase structure composed of only the Al phase and the $Al_4Ca$ phase, and also, may have a three-phase structure composed of the Al phase, the $Al_4Ca$ phase and other phase (one or more than one phase), or may have a multiple-phase structure composed of more than those phases.

As described above, the stress-buffering material according to the present invention is lightweight and has high formability, high intensity and low Young's modulus, and also has high thermal conductivity, a low coefficient of linear expansion and excellent productivity, and further achieves low-cost manufacturing, thereby widely applying to various products. For instance, when the stress-buffering material according to the present invention is used as a component of a semiconductor module (such as wiring members), it is possible to effectively lower thermal stress caused by a difference of the coefficient of thermal expansion from a semiconductor and a ceramic insulating substrate, thereby contributing to life improvement, downsizing and efficiency enhancement of the module. Meanwhile, when the stress-buffering material according to the present invention is used for arms and the like of a robot, it is possible to make the arms low-stress when trying to hold an object, thereby holding the object without breaking. Moreover, it is possible to easily control the arms when operating due to lightweight.

Moreover, since the stress-buffering material according to the present invention can effectively lower stress caused in a product, it can be applied to various products in various fields. For instance, it can be applied to various metal seals such as a metal seal provided at an inlet of a hydroforming device. Note that, the stress-buffering material according to the present invention is not limited to the above-described purposes, and can be widely applied to technical fields in which low mechanical stress and thermal stress with low Young's modulus is required.

The following are specific descriptions with regard to the best mode for carrying out the present invention.

The stress-buffering material according to the present invention is composed of the Ca-containing aluminum alloy mainly including Al. However, Al is a remainder, and the inclusion is not limited. For instance, when considering atomic weight ratio, the inclusion is not limited if the highest content element among elements included is Al. Particularly, when the entire Al alloy is 100 at %, the Al base alloy in which the Al content is 70 at % or more, preferably 85 at % or more, more preferably 90 at % or more is preferable in view of achieving low density and low elasticity. Naturally, unavoidable impurities may be present therein.

Ca is an element for dispersing $Al_4Ca$ as a second phase and lowering Young's modulus. When the entire Al alloy is 100 at %, the Ca content is preferably within the range of 0.1 at % to 12 at %. When the Ca content is less than 0.1 at %, the amount of $Al_4Ca$ is extremely low which is insufficient for an effect to lower Young's modulus. On the other hand, when the Ca content exceeds 12 at %, most of the constituent phases result in $Al_4Ca$, which is poor in ductility. Thus, the stress-buffering material having the intended configuration cannot be obtained because of serious embrittlement (refer to Comparative Example 1 with 14.7 at % of Ca content described below).

The Ca content is more preferably within the range of 3 to 10 at %, whereby it is possible to simultaneously obtain sufficient intensity and ductility in addition to sufficiently low Young's modulus. The Ca content is most preferably within the range of 6.0 to 10.0 at %. When the Ca content exceeds 10 at %, the $Al_2Ca$ phase easily appears at melting production. Since the $Al_2Ca$ phase causes performance deterioration when being present ununiformly, a process to remove the $Al_2Ca$ phase is additionally needed, which may result in high production costs. While, when the Ca content is below 3 at %, it is hard to obtain sufficiently low Young's modulus as low as less than 60 GPa.

In addition, the Ca-containing aluminum alloy composing the stress-buffering material according to the present invention may be composed of only Ca, Al and unavoidable impurities as an elementary composition having the Ca content within the above-defined range. In this case, in view of the effects of the present invention to be expressed, the Ca content range can be widely obtained as defined above compared with the case where a ternary element such as Zn is included other than Ca and Al. Thus, the present invention has the advantage that the content range to be set is widely obtained without strictly controlling the Ca content. Moreover, compared with the case where a ternary element such as Zn, Zr and Ti is included other than Ca and Al, the present invention has the advantage that the low-cost stress-buffering material can be offered since the alloy without including such a ternary element can be alloyed (manufactured) at relatively lower costs.

Meanwhile, the Ca-containing aluminum alloy composing the stress-buffering material according to the present invention may include the following elements (hereinafter, also referred to as a ternary element) other than the above-mentioned Ca. For instance, an element (ternary element), such as an element of group II such as Mg, Sr, Ba; an element of groups IV to XI (transition metal element) such as Mn, Cu, Fe, Ti, Cr, Zr; an element of group XII (zinc group element) such as Zn; an element of group XIV such as Si; and an element of group XV such as P, can be included. In other words, the Ca-containing aluminum alloy composing the stress-buffering material according to the present invention does not eliminate including the above-described ternary elements without departing from the scope of the stress-buffering material according to the present invention.

For instance, when Zr of the group XII element (zinc group element) is included, more than 7.6 at % to 12 at % or less of Ca ($7.6<Ca\leqq 12$ at %) and more than 0 at % to less than 3.5 at % of Zn ($0<Zn<3.5$ at %) are preferably included (refer to Examples in Table 3). By including more than 7.6 at %, preferably 8.0 at % or more, more preferably 8.5 at % or more of Ca, it is possible to simultaneously obtain sufficient intensity in addition to sufficiently low Young's modulus (45 GPa or less of dynamic Young's modulus). Moreover, by including 12 at % or less, preferably 10 at % or less, preferably 9.5 at % or less of Ca, it is possible to control a volume fraction of $Al_4Ca$ that is poor in ductility, and manufacture the stress-buffering material having an intended configuration (contrastingly refer to Example 3 with 11.6 at % of the Ca content and Comparative Example 1 with 14.7 at % of the Ca content described below). Furthermore, when including less than 3.5 at %, preferably 3 at % or less, more preferably 2.5 at % or less of Zn, it is possible to simultaneously obtain sufficient intensity and ductility in addition to sufficiently low Young's modulus. Note that, the lower limit of the Zn content is not specifically limited.

However, even when the contents of Ca and Zn depart from the above-mentioned ranges, the alloy including those can be used in the stress-buffering material according to the present invention, and such an alloy should not be excluded if the contents are within the range not detracting from acting effects of the stress-buffering material according to the present invention. For instance, as shown in Sample No. 4 (Example 6) in Table 3 described below, when the Zn content is as small as less than 1.0 at %, such an alloy can be used in the stress-buffering material according to the present invention without detracting from action effects of the present invention even when the Ca content is 7.6 at % or less. Specifically, it is possible to simultaneously obtain sufficient intensity and ductility with low Young's modulus (approximately 50 GPa of dynamic Young's modulus).

When Zr of a transition metal element is included as a ternary element, it is preferable that the Ca content is 0.1 to 12 at % and the Zr content is more than 0 at % to 0.15 at % or less, and it is more preferable that the Ca content is 3 to 10 at % and the Zr content is 0.01 at % to 0.10 at % (refer to Table 3). When the contents of Ca and Zr are within the above-described ranges, it is possible to simultaneously obtain sufficient intensity and ductility with low Young's modulus (approximately 45 GPa or less of dynamic Young's modulus). However, even when the contents depart from the above-described ranges, the alloy including those can be used in the stress-buffering material according to the present invention, and such an alloy should not be excluded if the contents are within the range not detracting from acting effects of the present invention.

When Ti of a transition metal element is included as a ternary element, it is also preferable that the Ca content is 0.1 to 12 at % and the Ti content is more than 0 at % to less than 0.15 at %, and it is more preferable that the Ca content is 3 to 10 at % and the Ti content is 0.01 at % to 0.10 at % or less (refer to Table 3). When the contents of Ca and Ti are within the above-described ranges, it is possible to simultaneously obtain sufficient intensity and ductility with low Young's modulus (approximately 45 GPa or less of dynamic Young's modulus). However, even when the contents depart from the above-described ranges, the alloy including those can be used in the stress-buffering material according to the present invention, and such an alloy should not be excluded if the contents are within the range not detracting from acting effects of the present invention.

As for the other ternary elements (such as Mg, Si, Mn, Cu, Fe, P, Ba, Sr, Cr) other than Zn, Zr and Ti, those may be also included with a proper amount (preferably minute amount) without departing from the scope of the stress-buffering material according to the present invention.

In addition, it is preferable that the Ca-containing aluminum alloy composing the stress-buffering material according to the present invention is constructed of at least Al and a second phase composed of $Al_4Ca$, in which a volume fraction of the second phase composed of $Al_4Ca$ is within the range of 20 to 70%, more preferably 30 to 50%. When the volume fraction of the second phase is less than 20%, although ductility is maintained, the effect to lower Young's modulus of $Al_4Ca$ is achieved little. When the volume fraction of the second phase exceeds 70%, Young's modulus can be greatly lowered, however, the Al phase with high ductility (hereinafter also referred to as a first phase or Al matrix) is segmented, which results in poor ductility. A structure observation and the volume fraction of the second phase of the Ca-containing aluminum alloy composing the stress-buffering material according to the present invention can be obtained by means of a measurement method described in Examples described below.

Figure 2:
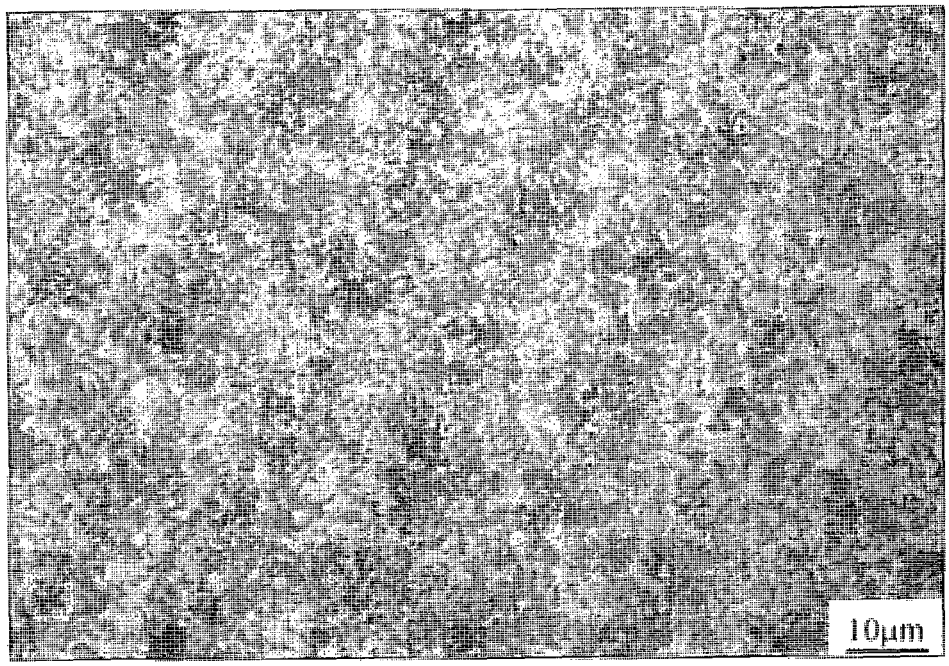
FIG. 2 is an optical micrograph of a Ca-containing aluminum alloy of Example 2.
Figure 3:
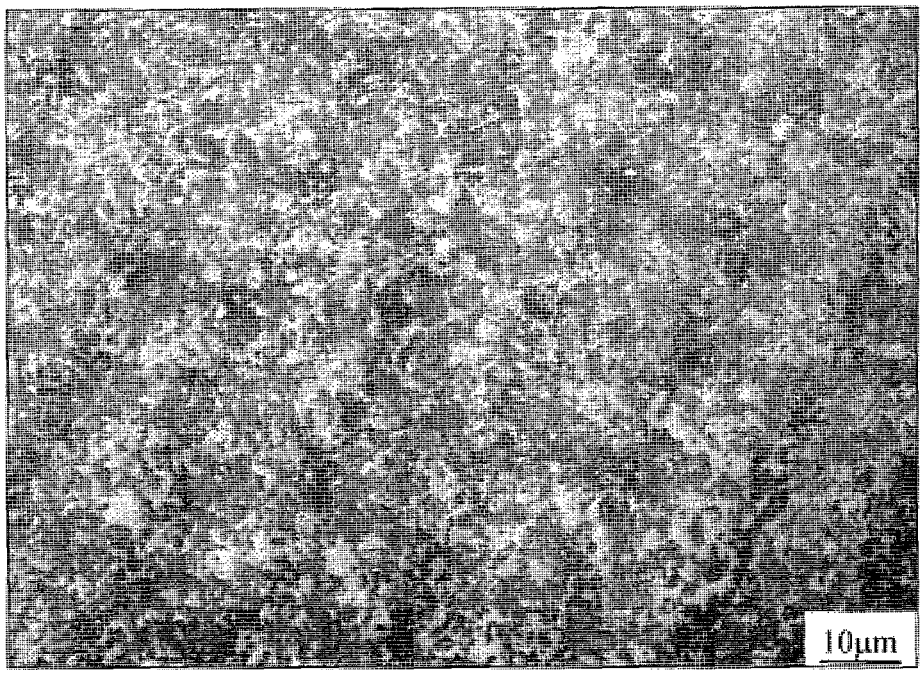
FIG. 3 is an optical micrograph of a Ca-containing aluminum alloy of Example 3.
Figure 4:
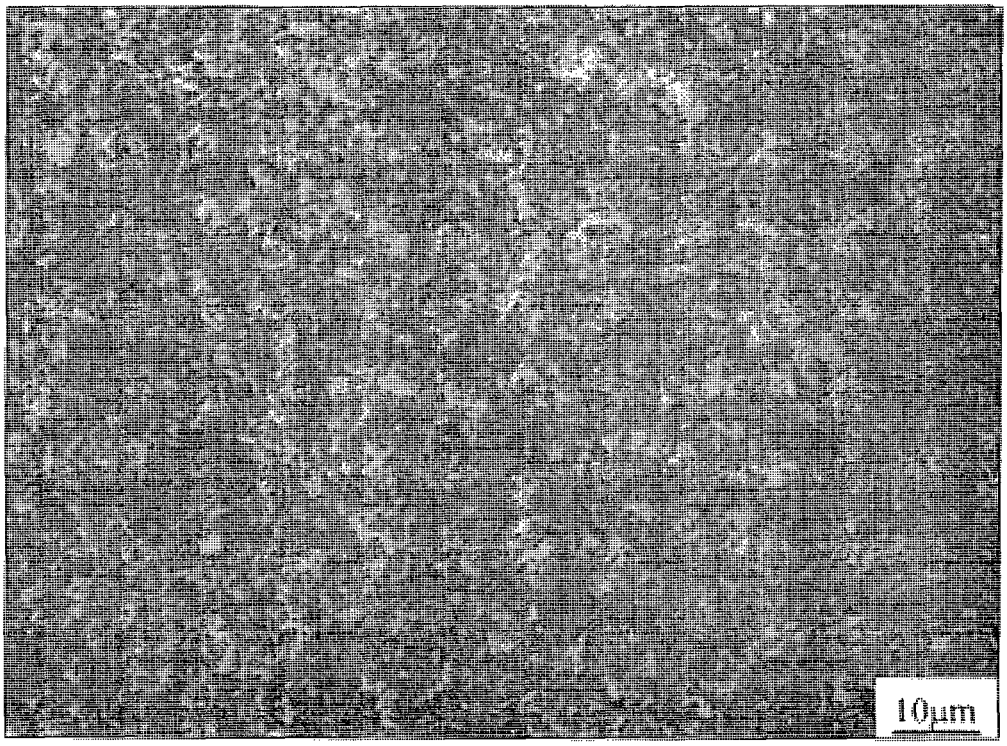
FIG. 4 is an optical micrograph of a Ca-containing aluminum alloy of Comparative Example 1.

Moreover, it is preferable that the Ca-containing aluminum alloy composing the stress-buffering material according to the present invention is constructed of at least Al and a second phase composed of $Al_4Ca$, in which the above second phase is dispersed in an Al matrix (refer to FIGS. 2 to 4). More preferably, the second phase is uniformly dispersed in the Al matrix (refer to FIGS. 2 and 3). When the matrix is connected with pure Al in a state of network, sufficient ductility can be maintained. In addition, it is possible to suppress a deterioration of thermal conductivity and electrical resistance of the Ca-containing aluminum alloy composing the stress-buffering material according to the present invention since Al in a state of network can have high thermal conductivity and low electrical resistance property. Therefore, the alloy can be appropriately used in the stress-buffering material for components such as wiring members and various metal seals of a semiconductor module, and the like. A dispersion of the second phase can be verified by the above-mentioned structure observation. It can be considered that the second phase is uniformly dispersed in the Al matrix when the matrix is connected with pure Al in a state of network. Note that, the configuration of the second phase composed of $Al_4Ca$ being dispersed in the Al matrix (here, the configuration is a cross-sectional configuration when being arbitrary cut off) is not particularly limited.

Furthermore, it is preferable that the Ca-containing aluminum alloy composing the stress-buffering material according to the present invention is constructed of at least Al and a second phase composed of $Al_4Ca$, in which an average size of the second phase is within the range of 0.01 to 20 μm. When the average size of the second phase is below 0.01 μm, strains are accumulated a lot at interfaces between Al lattices to be the matrix, which may significantly lower thermal conductivity. While, when the average size of the second phase is enlarged beyond 20 μm, deterioration due to fatigue characteristics may be caused. The average size of the second phase was obtained by (1) calculating an average area of second phase particles by binarizing by an image analysis according to observation results of structure micrographs by an optical microscope in a direction perpendicular to a longitudinal direction of a rod material of the aluminum alloy similar to the volume fraction of the second phase described in Examples, (2) similarly calculating an average area of the second phase particles in a direction parallel to a longitudinal direction, and (3) calculating a diameter of a sphere from the obtained average areas, assuming that the second phase has a spherical shape.

It is further preferable that the Ca-containing aluminum alloy composing the stress-buffering material according to the present invention is constructed of at least Al and a second phase composed of $Al_4Ca$, in which a diffraction peak of Al and $Al_4Ca$ by an X-ray diffraction method meets the following formula (1). In the formula (1), $I_{Al}$ (111) represents (111) surface reflection intensity of Al, and $I_{Al4Ca}$, (112) represents (112) surface reflection intensity of $Al_4Ca$.

[Math 2]

$$2.5 \leqq I_{Al}(111)/I_{Al4Ca}(112) \leqq 100 \quad (1)$$

When a left-hand side of an inequality ($I_{Al}$ (111)/$I_{Al4Ca}$ (112)) in the above formula (I) is less than 2.5, the amount of $Al_4Ca$ is too much and an embrittlement degree becomes large. While, when the value is more than 100, the amount of $Al_4Ca$ is too small and it is hard to obtain sufficiently low Young's modulus. Preferably, the diffraction peak of Al and $Al_4Ca$ by the X-ray diffraction method meets $5 \leqq I_{Al}$ (111)/$I_{Al4Ca}$ (112)$\leqq 50$. Note that, the X-ray diffraction is to be measured at room temperature, and results measured by powdering and removing anisotropy are to be used when integration of an assembled structure is relatively high and when a crystal grain is large.

Static Young's modulus of the Ca-containing aluminum alloy composing the stress-buffering material according to the present invention is preferably 60 GPa or less, more preferably less than 50 GPa, especially within the range of 30 to 50 GPa. Similarly, dynamic Young's modulus is 55 GPa or less, preferably 50 GPa or less, more preferably 45 GPa or less, especially within the range of 30 to 45 GPa. Due to an addition of Ca in the present invention, the Ca-containing aluminum alloy composing the stress-buffering material with an alloy configuration at low cost and suitable for mass production can be obtained without using a carbon fiber-reinforced Al composite material. The carbon fiber-reinforced Al composite material is expensive and costly to manufacture, and unfavorable for mass production because of a complicated production process. In other words, it is possible to obtain the Ca-containing aluminum alloy having low Young's modulus with 60 GPa or less of static Young's modulus (55 GPa or less of dynamic Young's modulus) that is beyond a conventional level. Therefore, forming processing and secondary processing (such as punching, cutting and bending) for hands and fingers of robots and auxiliary materials for artificial bones and the like, and further fine processing for wiring members and metal seals of a semiconductor module and the like using the alloy configuration can be easily performed. Thus, the Ca-containing aluminum alloy has the advantage of being able to further expand its use in various technical fields since stress-buffering materials having various shapes and configurations can be easily manufactured from the Ca-containing aluminum alloy. On the other hand, when static Young's modulus of the Ca-containing aluminum alloy is above 60 GPa or dynamic Young's modulus of the Ca-containing aluminum alloy is above 55 GPa, such Young's modulus cannot be considered as sufficiently low Young's modulus that is beyond a conventional level, and it is difficult to expand the use in the stress-buffering material, i.e. a desired purpose. Note that, static Young's modulus is determined according to JIS Z 2280:1993 (Test method for Young's modulus of metallic materials at elevated temperature). Similarly, dynamic Young's modulus is determined according to JIS Z 2280:1993 (Test method for Young's modulus of metallic materials at elevated temperature). With regard to this matter, a description will be made below in detail in the later-described examples. In addition, static and dynamic Young's modulus generally has temperature dependency, however, it is assumed that static and dynamic Young's modulus according to the present invention has values measured at room temperature.

The Ca-containing aluminum alloy composing the stress-buffering material according to the present invention and a method of manufacturing the stress-buffering material using the alloy are not particularly limited. As for the method of manufacturing the Ca-containing aluminum alloy, the alloy may be manufactured by being melted by use of various melting methods generally used in aluminum alloys, for instance. The obtained ingot can be also processed for molding by a method generally used such as hot rolling, hot forging, extrusion, cold rolling and drawing. The alloy can be manufactured by various methods other than the above-mentioned methods, such as superplastic forming and sintering. As for the method of manufacturing the stress-buffering material composed of such an alloy, hot rolling, hot forging, extrusion, cold rolling, drawing, superplastic forming and sintering and the like can be used, and a wire rod or a plate material or the like composed of the above-mentioned ingot or alloy processed from the ingot by means of the above manufacturing method can be directly used as a stress-buffering material. In addition, by using the above-mentioned ingot and processed alloy with a mold and die having a desired shape, forming processing for hands and fingers of robots and auxiliary materials for artificial bones and the like can be achieved. The secondary processing (such as punching, cutting and bending) can be also achieved. Furthermore, fine processing for wiring members and metal seals of a semiconductor module and the like can be achieved.

EXAMPLES

Hereinafter, a description will be made below in detail of the present invention with reference to Examples and Comparative Examples. However, the present invention is not limited to these Examples.

Examples 1 to 3 and Comparative Example 1

Aluminum alloys having compositions shown in Table 1 were manufactured as follow.

A pure metal of Al and Ca with a purity of 99.9% or more was used, and alloy powder (average particle diameter: approximately 50 μm) having the compositions shown in Table 1 was prepared by means of an atomization method. The alloy powder was put in a container (diameter of 50 mm), and degassed at 300 to 400° C., followed by extruding in a shape of a rod with a diameter of 10 mm at 400° C.

Comparative Example 2

Commercially available pure Al (A1070) with a diameter of 10 mm manufactured by a common method was annealed at 400° C. for 1 hour.

Comparative Example 3

T6 process was performed to A4032 alloy with a diameter of 10 mm manufactured by a common method.

(Evaluation Method)

The above-described aluminum alloys in each example were evaluated as follow.

1. Young's Modulus (1) Static Young's Modulus

With respect to each example of Examples 1 to 3 and Comparative Examples 2 to 3, static Young's modulus in a longitudinal direction of a rod was measured at room temperature by a tensile test according to JIS Z 2280:1993 (Test method for Young's modulus of metallic materials at elevated temperature). The result is shown in Table 1. Note that, a test piece of Comparative Example 1 could not be prepared due to brittleness.

(1) Dynamic Young's Modulus

With respect to each example of Examples 1 to 3 and Comparative Examples 2 to 3, dynamic Young's modulus in a rolling direction or powder extrusion direction was measured at room temperature by a transverse resonance technique or ultrasonic pulse technique according to JIS Z 2280: 1993 (Test method for Young's modulus of metallic materials at elevated temperature). The result is shown in Table 1. Note that, a test piece of Comparative Example 1 could not be prepared due to brittleness.

2. X-Ray Diffraction

With respect to each example of Examples 1 to 3 and Comparative Example 1, a constituent phase at room temperature was examined by use of an X-ray diffraction. As for the X-ray measurement, samples heat-treated at 300° C. for 10 minutes to eliminate strain were used after powdering a rod material. A Cu target was used. As one example of the measurement results, an X-ray diffraction pattern of Example 3 was shown in FIG. 1. The peak was analyzed and the constituent phase was determined. The result is shown in Table 1. It was found that each had a two-phase structure of Al (first phase and Al matrix) and $Al_4Ca$ (second phase). In addition, in the obtained diffraction peaks, a ratio of (111) surface reflection intensity of Al to (112) surface reflection intensity of $Al_4Ca$ was obtained, and the result was shown in Table 2.

3. Structure Observation and Volume Fraction of Second Phase

With regard to aluminum alloys of Examples 1 to 3 and Comparative Example 1, structure micrographs of a vertical section with respect to a longitudinal direction of a rod material by an optical microscope are shown in FIGS. 2 to 4. While showing the two-phase structure in the figures, it was recognized that dark parts in the figures were the second phase composed of $Al_4Ca$, and pale parts were Al by an EPMA analysis. An area fraction of the second phase composed of $Al_4Ca$ was obtained by binarizing by an image analysis according to the observation results. Moreover, an area fraction of a parallel section in a longitudinal direction was similarly obtained from the micrographs by the optical microscope, followed by calculating an average value of the area fraction of the parallel section and the area fraction of the vertical section, thus obtaining a volume fraction. Note that, in any of Examples 1 to 3 and Comparative Example 1, a considerable difference of the structures in an observation direction was not found.

4. Tensile Test

With respect to each example of Examples 1 to 3 and Comparative Examples 2 to 3, a 0.2% proof stress, tensile strength and percentage elongation were measured at room temperature by a tensile test according to JIS Z 2241:1998 (Method of tensile test for metallic materials). The result is shown in Table 1. Note that, a test piece of Comparative Example 1 could not be prepared due to brittleness.

5. Coefficient of Thermal Expansion (Average Coefficient of Linear Expansion)

With respect to Examples 1 to 3 and Comparative Examples 2 to 3, an average coefficient of linear expansion was measured by a TMA (Thermal Mechanical Analysis) measurement. Test pieces were configured to have a diameter of 5 mm $\phi$×20 mm and a rate of rising and falling temperatures was at 5° C./minute, and thus, the average coefficient of linear expansion within the range of −50° C. to 300° C. was obtained. The result is shown in Table 1. Note that, a test piece of Comparative Example 1 could not be prepared due to brittleness.

6. Thermal Conductivity

With respect to each example of Examples 1 to 3 and Comparative Examples 2 to 3, thermal conductivity at room temperature was measured by a laser flash method. The result is shown in Table 1. Note that, a test piece of Comparative Example 1 could not be prepared due to brittleness.

7. Density

With respect to each example of Examples 1 to 3 and Comparative Examples 2 to 3, a density was calculated by measuring sizes and weights at room temperature. The result is shown in Table 1. Note that, a test piece of Comparative Example 1 could not be prepared due to brittleness.

TABLE 1

| | Component | | | Examination | Volume Fraction | Static | Dynamic | 0.2% | | Percentage | Average Coefficient | Thermal | Density |
|---|---|---|---|---|---|---|---|---|---|---|---|---|---|
| No. | Ca Content [at %] | Other | Al | of Constituent Phase | of $Al_4Ca$ Phase [%] | Young's Modulus [Gpa] | Young's Modulus [Gpa] | Proof Stress [Mpa] | Tensile Stength [Mpa] | Elongation [%] | of Linear Expansion [ppm/K] | Conductivity [W/m · K] | [g/cm$^3$] |
| Ex. 1 | 4.9 | | Remainder | Al + $Al_4Ca$ | 26 | 55 | 52.1 | 192 | 274 | 29 | 22.0 | 139 | 2.58 |
| Ex. 2 | 8.9 | | Remainder | Al + $Al_4Ca$ | 47 | 43.5 | 37.3 | 230 | 285 | 0.5 | 19.0 | 108 | 2.49 |
| Ex. 3 | 11.6 | | Remainder | Al + $Al_4Ca$ | 62 | 34 | 30.8 | — | 185 | 0 | 17.7 | 77.6 | 2.44 |
| Com. Ex. 1 | 14.7 | | Remainder | Al + $Al_4Ca$ | 75 | — | — | — | — | — | — | — | — |
| Com. Ex. 2 | 0 | A1070 | Remainder | — | 0 | 68 | 67.3 | 48 | 68 | 48 | 23.5 | 225 | 2.70 |
| Com. Ex. 3 | 0 | A4032 | Remainder | — | 0 | 77 | 75.7 | 315 | 380 | 7 | 20.0 | 145 | 2.68 |

Alloy compositions other than Al of "A4032" shown in a section of "other" in components of Comparative Example 3 in Table 1 are Si: 11.8%, Fe: 0.49%, Cu: 0.43%, Mg: 1.13%, Cr: 0.05%, Zn: 0.1% and Ni: 0.47%. Each component "%" of those alloy compositions represents "wt %", respectively.

TABLE 2

| No. | $I_{Al}$ (111)/$I_{Al4Ca}$ (112) |
|---|---|
| Example 1 | 45.7 |
| Example 2 | 29.1 |
| Example 3 | 9.7 |
| Comparative Example 1 | 2.3 |

According to the result in Table 1, the aluminum alloys of Examples 1 to 3 had 60 GPa or less of static Young's modulus, and also 55 GPa or less of dynamic Young's modulus, which resulted in sufficiently low Young's modulus. Especially, Example 2 and Example 3 could lower static Young's modulus to 50 GPa or less, and dynamic Young's modulus to 45 GPa or less.

Comparing Example 1 including 5 at % of Ca with Example 3 including a large amount of Ca (12 at %), Young's modulus of Example 3 was lowered more, and Example 3 could obtain remarkably low Young's modulus as low as 30 s GPa of static and dynamic Young's modulus. However, it was found that Example 3 including a large amount of Ca had poor ductility due to a less percentage elongation in the tensile test. Furthermore, it was found that Comparative Example 1 including more than 12 at % of Ca could not obtain a test piece because the sample was too brittle.

Next, it was found that each constituent phase of Examples 1 to 3 and Comparative Example 1 was the two-phase structure of Al and $Al_4Ca$. Especially, it was found that Examples 1 to 3, in which the volume fraction of the second phase composing $Al_4Ca$ was controlled within the range of 20 to 70%, had low Young's modulus and no embrittlement.

Next, it can be seen in the micrographs shown in FIGS. 2 to 4 that, while the $Al_4Ca$ phase is uniformly dispersed in the Al matrix in Example 2 in FIG. 2, the $Al_4Ca$ phase is increased as the Ca amount is increased more than Example 3 in FIG. 3, and the network structure of Al is segmented. Comparing properties between Example 2 and Example 3, it can be seen that such a structure lowers thermal conductivity and ductility (refer to Table 1). Note that, it could be recognized from the micrographs that the $Al_4Ca$ phase in Example 1 was uniformly dispersed in the Al matrix more than Example 2 (the figure of the micrograph of Example 1 was omitted due to a similarity to the micrograph of Example 2). In other words, it can be described that $Al_4Ca$ is dispersed in Al, or Al is dispersed in $Al_4Ca$ when the $Al_4Ca$ phase is increased. Thus, the network structure of $Al_4Ca$ is gradually formed in accordance with the increase of the Ca amount, and the network structure of Al is segmented (decreased). Moreover, it was found that the second phase composed of $Al_4Ca$ shown in FIG. 2 included two sizes, i.e. small one of approximately 1 μm, and the other one of approximately 5 to 10 μm, and the average size was approximately 3 μm. It was recognized that such a size within the above-mentioned range could maintain a sufficient mechanical property and thermal conductivity (refer to Table 1).

Next, according to the X-ray diffraction intensity ratio shown in Table 2, it was found that Comparative Example 1, in which $I_{Al}$ (111)/$I_{Al4Ca}$ (112) was below 2.5, included too much $Al_4Ca$, and embrittlement resulted in a higher ratio. While, it was recognized that $I_{Al}$ (111) $I_{Al4Ca}$ (112) of Examples 1 to 3 was within the range of 2.5 to 100, and thus, sufficiently low Young's modulus and intensity could be obtained simultaneously.

In the tensile test result shown in Table 1, it was found that Example 1 had approximately 30% of the elongation, which was a quite high ductility. Examples 2 and 3 had poor ductility, however, it was found that Examples 2 and 3 had intensity enough not to be damaged even when up to 200 MPa level of stress was applied thereto. Note that, the 0.2 proof stress of Example 3 is not described since plastic strain enough to calculate the 0.2 proof stress could not be obtained in Example 3. In addition, according to the results of thermal conductivity and density of Examples 1 to 3 shown in Table 1, when using the alloy for a purpose requiring moldability and high thermal conductivity, it is preferable that the example including relatively less $Al_4Ca$ such as Example 1 be used. While, when using the alloy for a purpose requiring low density, low Young's modulus less than the Mg alloy and low coefficient of linear expansion, the example such as Example 3 in the present invention can be appropriately used.

Meanwhile, Comparative Example 2 did include no Ca that is an element to lower Young's modulus, and Young's modulus thus resulted in a higher ratio. The aluminum alloy shown in Comparative Example 3 did include no Ca, while including elements such as Si, which resulted in higher Young's modulus than pure Al.

Sample No. 1 to 14

Examples 4 to 13 and Comparative Examples 4 to 7

Plate material samples (Sample No. 1 to 14) of the aluminum alloys having compositions shown in Table 3 were prepared as followed.

A pure metal of Al and Ca with a purity of 99.9% or more and further Zn, Zr and Ti was used, and melted by high-frequency melting, followed by pouring the melted metal into a cast-iron mold, thus obtaining an ingot with approximately 100 to 500 g. The obtained ingot was cut into pieces having a size of 15 mm×15 mm×approximately 100 mm, followed by heat treating in vacuum at 500° C. for 24 hours for homogenization. Then, each piece was rolled so as to have a plate thickness of 2.0 to 2.5 mm by hot-rolling at 500° C., thus obtaining plate materials. The following evaluations were performed with respect to the plate materials manufactured as described above.

(Evaluation Method)

The aluminum alloys in each example of the above-mentioned Sample No. 1 to 14 (Examples 4 to 13 and Comparative Examples 4 to 7) were evaluated as followed.

1. Dynamic Young's Modulus

With respect to each example of Sample No. 1 to 14 (Examples 4 to 13 and Comparative Examples 4 to 7), dynamic Young's modulus in a rolling direction was measured at room temperature by a transverse resonance technique or ultrasonic pulse technique according to JIS Z 2280:1993 (Test method for Young's modulus of metallic materials at elevated temperature). The result is shown in Table 3. Note that, a test piece of Sample No. 9 (Comparative Example 7) could not be prepared due to brittleness.

TABLE 3

| Sample No. | | Component [at %] Ca | Zn | Zr | Ti | Al | Dynamic Young's Modulus [GPa] |
|---|---|---|---|---|---|---|---|
| 1 | Example 4 | 6.8 | — | — | — | Remainder | 44.9 |
| 2 | Example 5 | 7.9 | — | — | — | Remainder | 39.0 |
| 3 | Comparative Example 4 | 3.5 | 2.2 | — | — | Remainder | 71.2 |
| 4 | Example 6 | 7.3 | 0.9 | — | — | Remainder | 50.6 |

TABLE 3-continued

| Sample No. | | Component [at %] Ca | Zn | Zr | Ti | Al | Dynamic Young's Modulus [GPa] |
|---|---|---|---|---|---|---|---|
| 5 | Comparative Example 5 | 6.9 | 2.0 | — | — | Remainder | 57.8 |
| 6 | Comparative Example 6 | 7.6 | 3.7 | — | — | Remainder | 60.7 |
| 7 | Example 7 | 9.1 | 1.0 | — | — | Remainder | 38.6 |
| 8 | Example 8 | 9.2 | 2.3 | — | — | Remainder | 43.4 |
| 9 | Comparative Example 7 | 8.8 | 3.5 | — | — | Remainder | — |
| 10 | Example 9 | 8.5 | — | — | — | Remainder | 41.2 |
| 11 | Example 10 | 8.6 | — | 0.03 | — | Remainder | 40.9 |
| 12 | Example 11 | 8.4 | — | 0.09 | — | Remainder | 43.5 |
| 13 | Example 12 | 8.6 | — | | — | Remainder | 39.4 |
| 14 | Example 13 | 8.6 | — | | 0.02 | Remainder | 42.8 |

According to the result in Table 3, when including Zn as a ternary element, dynamic Young's modulus could be lowered to 45 GPa or less including more than 7.6 at % to 12 at % or less of Ca and more than 0 at % to less than 3.5 at % of Zn as shown in Examples 7 and 8, which resulted in quite low Young's modulus. Even including less than 7.6 at % of Ca as Example 6, dynamic Young's modulus was 55 GPa or less when including Zn with a small range as small as less than 2.0 at %, which resulted in sufficiently low Young's modulus. On the other hand, as shown in Comparative Examples 4 to 6, when including less than 7.6 at % of Ca and 2.0 at % or more of Zn, it was found that dynamic Young's modulus resulted in a higher ratio above 55 GPa, and it was hard to obtain sufficiently low Young's modulus. Moreover, as shown in Comparative Example 7, even when including more than 7.6 at % to 12 at % or less of Ca, it was found that the stress-buffering material having a desired configuration could not be obtained due to serious embrittlement when including 3.5 at % or more of Zn. Furthermore, compared with the case where Zn was not included as a ternary element (Ca content was approximately the same) as Example 2 in Table 1, it was found that dynamic Young's modulus in Examples 7 and 8 was increased, although a degree of increase was very slight.

Similarly, in the case of including Zr or Ti as a ternary element, it was found that dynamic Young's modulus was 45 GPa or less when including 0.1 to 12 at % of Ca, and more than 0 to 0.15 at % or less of Zr or Ti as shown in Examples 10 to 11 and 13, which resulted in quite low Young's modulus. Compared with the case where Zr or Ti was not included as a ternary element (Ca content was approximately the same) as Examples 9 and 12, it was found that dynamic Young's modulus in Examples 10 to 11 and 13 could be lowered equally or slightly.

INDUSTRIAL APPLICABILITY

The present invention can be applied to products and components such as hands and fingers of robots and auxiliary materials for artificial bones, and products and components such as wiring members and various metal seals of a semiconductor module.

The invention claimed is:

1. A stress-buffering material including a Ca-containing aluminum alloy consisting of:

Al, 7.9 to 12 at % of Ca, and unavoidable impurities as an elementary composition, wherein the Ca-containing aluminum alloy includes a first phase of Al and a second phase including $Al_4$, Ca, wherein a volume fraction of the second phase of $Al_4Ca$ is within a range of 20 to 70%, and wherein an average size of the second phase of $Al_4Ca$ is within a range of 0.01 to 20 μm, and wherein when $I_{A1}$ (111) represents (111) surface reflection intensity of Al and $I_{Al4Ca}$ (112) represents (112) surface reflection intensity of $Al_4Ca$, a diffraction peak of Al and $Al_4Ca$ by an X-ray diffraction method meets a following formula:

$$2.5 \leqq I_{Al}(111)/I_{Al4Ca}(112) \leqq 100, \text{ and}$$

wherein static Young's modulus of the Ca-containing aluminum alloy is 60 GPa or less, dynamic Young's modulus of the Ca-containing aluminum alloy is 55 GPa or less, and both the static and the dynamic Young's moduli are determined according to Japanese industrial Standards Z 2280:1993 and are measured at room temperature.

2. The stress-buffering material according to claim 1, wherein the alloy consists of Al, 7.9 to 10 at % of Ca; and unavoidable impurities as an elementary composition.

3. The stress-buffering material according to claim 1, wherein the second phase of $Al_4Ca$ is dispersed in a matrix of the first phase of Al.

4. The stress-buffering material according to claim 1, wherein the Ca-containing aluminum alloy consists of Al, 7.9 to 11.6 at % of Ca, and unavoidable impurities as an elementary composition.

* * * * *

UNITED STATES PATENT AND TRADEMARK OFFICE

CERTIFICATE OF CORRECTION

PATENT NO. : 8,241,561 B2
APPLICATION NO. : 12/676271
DATED : August 14, 2012
INVENTOR(S) : Fumihiko Gejima, Hiroki Sakamoto and Mamoru Sayashi It is certified that error appears in the above-identified patent and that said Letters Patent is hereby corrected as shown below:

On the Title page of the Patent, the related PCT information should read:

| | | |
|---|---|---|
| **(22)** | **PCT Filed:** | **Sep. 11, 2008** |
| **(86)** | **PCT No.:** | **PCT/JP2008/066408** |
| | **§ 371 (c)(1), (2), (4) Date:** | **Mar. 3, 2010** |
| **(87)** | **PCT Pub. No.:** | **WO2009/035029** |
| | **PCT Pub. Date:** | **Mar. 19, 2009** |

Signed and Sealed this
Thirteenth Day of November, 2012

David J. Kappos

David J. Kappos
*Director of the United States Patent and Trademark Office*